United States Patent [19]

Isaka et al.

[11] Patent Number: 4,570,524

[45] Date of Patent: Feb. 18, 1986

[54] DRUM IN MUSIC BOX

[75] Inventors: Akihiko Isaka; Takeo Saito, both of Nagano, Japan

[73] Assignee: Kabushiki Kaisha Sankyo Seiki Seisakusho, Nagano, Japan

[21] Appl. No.: 459,910

[22] Filed: Jan. 21, 1983

[30] Foreign Application Priority Data

Apr. 19, 1982 [JP] Japan ..... 57-56637

[51] Int. Cl.[4] ..... G10F 1/06

[52] U.S. Cl. ..... 84/96

[58] Field of Search ..... 84/95 R, 95 C, 94 R, 84/94 C, 96

[56] References Cited

U.S. PATENT DOCUMENTS 3,688,626 9/1972 Cotey ..... 84/95

4,197,778 4/1980 Komatsu et al. ..... 84/95 R

FOREIGN PATENT DOCUMENTS 2760 10/1890 Switzerland ..... 84/95

*Primary Examiner*—Russell E. Adams

*Assistant Examiner*—Brian W. Brown

*Attorney, Agent, or Firm*—Sughrue, Mion, Zinn, Macpeak & Seas

[57] ABSTRACT

A drum for a music box comprises a cylindrical drum body, a pair of end plates fixed to end faces of said drum body, one of the end plate having an center opening, and an external output shaft (14) positioned in the opening and projecting outside of the cylindrical drum body. A diameter of the opening is much greater than that of the external output shaft. The drum includes portions for engaging with the external output shaft for preventing axial and rotational displacement between the external output shaft and the end plates. The engaging portions are provided within the cylindrical drum body.

3 Claims, 6 Drawing Figures

DRUM IN MUSIC BOX

BACKGROUND OF THE INVENTION

The present invention relates to a drum in a music box and more particularly to a drum which may have an external output shaft on which an attachment is to be fixed.

The music box can be divided broadly into two types. One is the type to enjoy the music playing and the other is the type to enjoy also the movement of the attachment such as dolls or the like in time to the music playing. The attachment is mounted to an external output shaft which rotates together with the drum.

In case the output is taken out from the drum shaft in accordance with the prior art, the external output shaft is formed in such a way as to be inserted into the central part of the drum and fixed thereto. Since the attachment is mounted to this external output shaft, an external force not only in the direction of rotation but also in the direction of axis is applied onto the shaft. Furthermore, it is required that the drum and the shaft be connected to each other by a sufficient force more than predetermined to be able to resist external forces.

The external output shaft is formed in such a way as to be inserted into the drum, thereby making it possible that the drum and the external output shaft are firmly connected to each other. However, it is required that they be connected to each other prior to the step of total assembly of the music box. It is important that the external output shaft be formed in such a way as to be inserted into the drum after the end of the step of total assembly.

There is a music box of a standard type which requires the external output shaft and a music box of a special type which does not require the external output shaft as mentioned herein. Thus, the external output shaft is not formed in such a way as to be inserted into the drum of every type.

Under such circumstances, drums of a standard type and special type are produced separately. In addition, in case the kinds of the programs of music to be played and of the external output shafts vary, the combination thereof results in various drums, thereby causing much management problems.

Furthermore, since the drum and bearing retaining mechanism are different between the standard type and the special type, it is required that the frame shape of the music box movement is prepared, taking into account the above mentioned difference. Then, there is further inconvenience in that the production and management problems increase.

In view of this defect, the present assignee has proposed a technique disclosed in the Japanese Utility Model Application Laid Open No. 1412/79, in which components such as a frame, a drum and the like are commonly used, and in which in particular, a bearing is separated into two members and thereafter, an external output shaft is assembled in the drum. However, since the bearing means for supporting the drum is fixed to the frame by press-fitting, the hollow bearing means will be deformed upon the press-fitting. Therefore, it is impossible in fact to assemble the output shaft in the drum after assembling the other parts. Also, the number of bearing members must be increased. This technique also will encounter the loss in production and management. The music box in which external output shafts are built is disadvantageous due to its physical size for transportation and packaging.

SUMMARY OF THE INVENTION

The present invention which has been achieved in view of the above inconvenience is to provide a drum in a music box in accordance with which the production and management loss can be removed.

According to the invention there is provided a drum for a music box comprising a cylindrical drum body, a pair of end plates fixed to end faces of said drum body, one of said end plate having a center opening, an external output shaft positioned in said opening and projecting outside of said cylindrical drum body, a diameter of said opening being much greater than that of said external output shaft and means for engaging with said external output shaft for preventing axial and rotational displacement between said external output shaft and said end plates, said engaging means being provided within said cylindrical drum body.

According to the invention there is provided a drum in a music box comprising an opening which is formed in at least one end plate at the center of rotation of the drum, the first engaging portion to substantially make integral an external output shaft which is adapted to pass through said opening and the drum in the direction of rotation, the second engaging portion which is positioned substantially at the center of rotation of the drum to substantially make integral axially the external output shaft which is adapted to pass through said opening and the drum and the third engaging portion which is positioned substantially at the center of rotation of the drum to regulate the depth that the external output shaft is inserted into said opening.

Then, since it is possible to easily connect the external output shaft as occasion demands after the completion of the step of total assembling of the music box in accordance with the present invention, it becomes unnecessary to produce and manage drums of a standard type and of a special type separately. This remarkably contributes to the enhancing of the production efficiency as well as the lowering of the cost not only in the total assembling of the music box but also in the assembling (partial assembling) of the drum.

In other words, since the drums are divided into the standard type and the special type, and the external output shaft can be easily mounted by hand operation without requiring any tools and special skills in accordance with the present invention, the drums (in more concrete, the movements into which the drums are assembled) and the external output shafts are forwarded without assembling them, and as occasion demands at the step of total assembling of the music box, they are assembled so as to constitute the drums of a special type. This makes it possible that the assembling cost is lowered, the management of parts becomes simple and furthermore, the cost for packing, transportation and the like is lowered.

DETAILED DESCRIPTION OF THE INVENTION

The present invention will now be explained in detail referring to the embodiment which is shown in the accompanying drawings.

Figure 1:
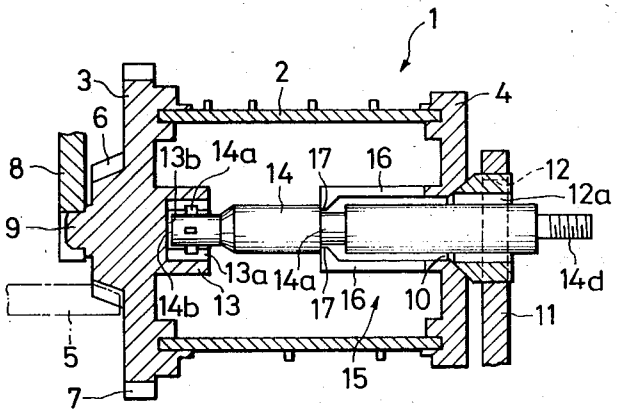
FIG. 1 is a front view in cross section showing one embodiment of a drum in a music box in accordance with the present invention.

Reference numeral 1 in FIG. 1 denotes a drum which is composed of a cylindrical drum body 2 and end plates 3, 4 which are fitted to both the ends of this drum body. There are provided teeth 6 which engage the first gear 5 which is energized by means of a spring, teeth 7 which are connected to a speed governor mechanism (not shown) and a shaft portion 9 which engages a bearing member on the end plate 3. The other end plate 4 is provided with an opening 10 at the center of rotation of the drum.

A bearing member 12 which is inserted into a frame bearing portion 11 and fixed thereto is fitted into the opening 10. Although the drum 1 is rotatably suported by the bearing portion 11 via the bearing member 12 in the embodiment shown, it is also acceptable that a tubular shaft portion (not shown) which is provided on the end plate 4 is supported by the bearing portion 11. A through hole 12*a* is formed in the bearing member 12.

Figure 2:
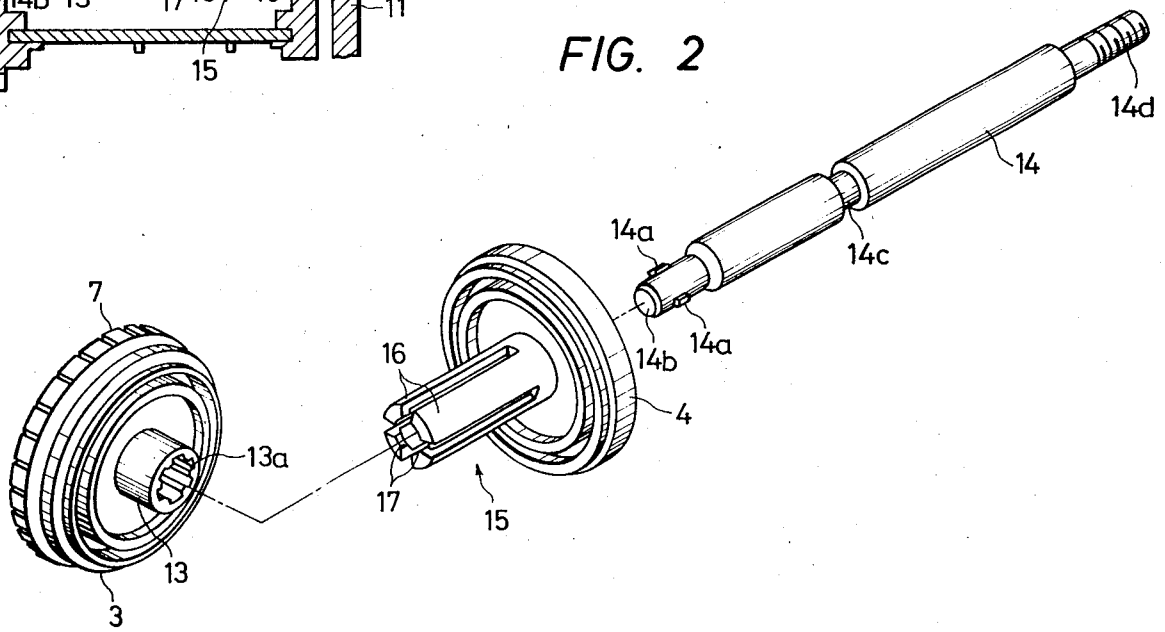
FIG. 2 is a perspective view showing essential parts in FIG. 1 in a disassembled state.

The first engaging portion 13 is provided on the inner surface of the end plate 3 on the center line of rotation of the drum as shown also in FIG. 2. There are formed axial engaging grooves 13*a* on the inner peripheral surface of this first engaging portion, which engage projections 14*a* which are formed on the peripheral surface at the end of an external output shaft 14. A diameter of the output shaft 14 is rather smaller than that of the above described opening 10 of the end plate 4.

In the case of the embodiment shown, the bottom portion 13*b* of the first engaging portion regulates the depth that the external output shaft 14 is pushed into the first engaging portion 13, in other words, forms the third engaging portion with which the end surface 14*b* of the external output shaft may contact.

The inner side of the end plate 4 is provided with the second engaging portion 15. The second engaging portion 15 is composed of a plurality (four in the embodiment) of elastic segments or arms 16 which extend towards the other end plate 3 and pawls 17 which are provided on the inner surfaces at the ends of the plurality of elastic segments. This second engaging portion 15 engages the peripheral groove 14*c* of the external output shaft 14, so that the shaft 14 and the drum 1 substantially become integral with each other in the axial direction.

The drum in accordance with the present invention is constituted as mentioned above. The drum is assembled into the music box movement when the external output shaft 14 is not yet mounted thereto as shown in FIG. 1. As a matter of convenience, this state will be referred to as "the reference type" in order to make a distinction between it and the above mentioned standard type.

In case this standard type is used in the music box of a special type, the external output shaft 14 is adapted to pass through the through hole 12*a* of the bearing member 12 and the opening 10 so that the projections 14*a* at the end thereof engage the grooves 13*a* and pushed until the end 14*b* thereof contacts with the bottom 13*b*. When the end portion of the external output shaft 14 is inserted, the elastic segments or arms 16 bend so that the pawls 17 go away. Then, when inserted until the end portion 14*b* of the shaft collides with the bottom portion 13*b*, the pawls 17 elastically get back so as to be fitted into the peripheral groove 14*c* on the shaft. There is formed a threaded portion 14*d* for mounting thereon an attachment (not shown) at one end of the external output shaft 14.

As mentioned above, the drum 1 substantially becomes integral with the inserted external output shaft 14 in the direction of rotation when the projections 14*a* engage the grooves 13*a*, while the drum 1 substantially becomes axially integral with the inserted external output shaft when the pawls 17 engage the peripheral groove 14*c*.

Figure 3A:
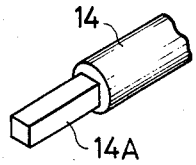
FIGS. 3(a) and (b) are perspective views showing other configurations of the engaging end of the external output shaft.
Figure 3B:
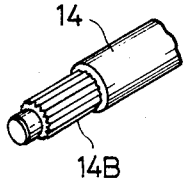

In the embodiment which is shown in FIG. 1 and FIG. 2, the first engaging portion is the axial grooves which are formed in such a way as to engage the projections 14*a* which are formed on the external output shaft 14, however, the invention is not limited thereto. It is also acceptable that the first engaging portion is of a configuration which complementally engages that of the end 14A or 14B of the external output shaft 14 as shown in FIGS. 3(a) and (b).

Although the first engaging portion (engaging grooves 13*a*) and the second engaging portion 15 (elastic arms 16, pawls 17) are provided in separate from each other, it is also possible to constitute in such a way that a single multi-function engaging portion works as the first, second and third engaging portions.

Figure 4:
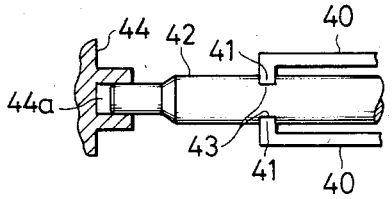
FIG. 4 is a front view in cross section showing another embodiment in accordance with the present invention.
Figure 5:
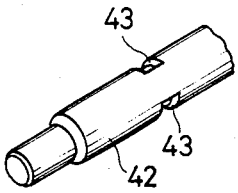
FIG. 5 is a perspective view showing essential parts of the external output shaft in FIG. 4.

Reference numeral 40 in FIG. 4 denotes elastic segments or arms which are provided on the end plate 4 and of which the free end is provided with engaging portions 41. On the other hand, the external output shaft 42 which engages the elastic arms is provided with a partial peripheral groove 43 for connection. Then, if the external output shaft 42 is inserted so that the peripheral groove 43 engages the portions 41, the shaft and the drum are connected substantially in integral with each other not only in the direction of rotation but also in the direction of axis. In case the load to the external output shaft is small, it is also acceptable to constitute as shown in FIG. 4. Furthermore, it is also acceptable that the end of the external output shaft 42 extends so as to be fitted into a hole 44*a* which is formed in the other end plate 44.

Although the drum is composed of the drum body and the pair of end plates in the above mentioned embodiment, the present invention is applicable in the case where the drum body and the end plates are integrally formed. It will be understood from the above that, if one reference type is prepared in accordance with the drum of this invention as mentioned above, it is not only possible to use this as the standard type but also possible to make this correspond to a plurality of special types by combining this with various kinds of external output shafts, thereby reducing the loss in the production or parts management by a large margin, with space-saving features for storing and transportation.

What is claimed is:

1. A drum for a music box comprising: an opening which is formed in one end plate at the center of rotation of the drum, bearing means having a through hole communicating with said center hole for rotatably supporting said end plate, first engaging means essentially making integral said drum to an external output shaft; said output shaft adapted to pass through said opening, said through hole and the drum in the direction of rotation; said opening and said through hole each having a diameter much greater than that of said output shaft; second engaging means for essentially making integral axially said external output shaft with said drum; and third engaging means for stopping the inner end of said external output shaft to be inserted into said opening; wherein said first, second and third engaging means are positioned together at a single predetermined position within said drum.

2. A drum for a music box comprising: an opening which is formed in one end plate at the center of rotation of the drum, bearing means having a through hole communicating with said center hole for rotatably supporting said end plate, first engaging means essentially making integral said drum to an external output shaft; said output shaft adapted to pass through said opening, said through hole and the drum in the direction of rotation; said opening and said through hole each having a diameter much greater than that of said output shaft; second engaging means for essentially making integral axially said external output shaft with said drum; and third engaging means for stopping the inner end of said external output shaft to be inserted into said opening; wherein said second engaging means comprises a plurality of elastic arms provided on an end plate of said drum and engagable with an annular groove formed in the external output shaft.

3. A drum for a music box comprising: an opening which is formed in one end plate at the center of rotation of the drum, bearing means having a through hole communicating with said center hole for rotatably supporting said end plate, first engaging means essentially making integral said drum to an external output shaft; said output shaft adapted to pass through said opening, said through hole and the drum in the direction of rotation; said opening and said through hole each having a diameter much greater than that of said output shaft; second engaging means for essentially making integral axially said external output shaft with said drum; and third engaging means for stopping the inner end of said external output shaft to be inserted into said opening, wherein said first, second and third engaging means are positioned together at a single predetermined position within said drum and comprise a plurality of arms made of elastic material and engageable with an annular groove formed in the external output shaft.

* * * * *